US005306084A

United States Patent [19]

Orii

[11] Patent Number: 5,306,084

[45] Date of Patent: Apr. 26, 1994

[54] PRINTING CONTROL SYSTEM AND THE METHOD

[75] Inventor: Yasunori Orii, Suwa, Japan

[73] Assignee: Seiko Epson Corporation, Tokyo, Japan

[21] Appl. No.: 834,254

[22] PCT Filed: Jun. 14, 1991

[86] PCT No.: PCT/JP91/00802

§ 371 Date: Feb. 11, 1992

§ 102(e) Date: Feb. 11, 1992

[87] PCT Pub. No.: WO91/19612

PCT Pub. Date: Dec. 26, 1991

[30] Foreign Application Priority Data

Jun. 15, 1990 [JP] Japan ..... 2-157191

[51] Int. Cl.[5] ..... B41J 2/30

[52] U.S. Cl. ..... 400/279; 400/121

[58] Field of Search ..... 400/124, 279, 320, 322, 400/121

[56] References Cited

U.S. PATENT DOCUMENTS

| | | | |
|---|---|---|---|
| 4,421,431 | 12/1983 | Dorrfub | 400/303 |
| 4,459,050 | 7/1984 | Goldberg et al. | 400/121 |
| 4,733,981 | 3/1988 | Takeuchi | 400/292 |
| 4,844,635 | 7/1989 | Malkemes | 400/322 |
| 4,877,343 | 10/1989 | Hori | 400/124 |

FOREIGN PATENT DOCUMENTS

| | | | |
|---|---|---|---|
| 2381629 | 9/1978 | France | 400/279 |
| 55-109677 | 8/1980 | Japan | 400/279 |
| 57-135184 | 8/1982 | Japan | 400/279 |
| 57-203580 | 12/1982 | Japan | 400/903 |
| 59-54571 | 3/1984 | Japan | 400/279 |
| 62-5871 | 1/1987 | Japan | 400/279 |
| 62-278071 | 12/1987 | Japan | 400/279 |
| 64-85773 | 3/1989 | Japan | 400/279 |

*Primary Examiner*—David A. Wiecking
*Assistant Examiner*—Steven S. Kelley
*Attorney, Agent, or Firm*—Ladas & Parry

[57] ABSTRACT

A printer controlling system which can perform printing at predetermined printing density even when the carriage is being accelerated or decelerated is disclosed. When the carriage is traveling, position pulses are generated at constant travel distance intervals. The carriage travel speed is measured on the basis of the time intervals during which the position pulses are generated. Further, the time at which the carriage reaches each predetermined printing position is estimated on the basis of the measured travel speed, and the actual printing is made when the current time matches the estimated arrival time.

6 Claims, 12 Drawing Sheets

PRINTING CONTROL SYSTEM AND THE METHOD

TECHNICAL FIELD

The present invention relates to a printing control system and method of controlling the printing timing of a printer.

BACKGROUND OF THE ART

In the prior-art printing control method of printers, the printing timing has been decided on the basis of the regular time intervals determined by the carriage travel speed and the printing density (the number of dots per unit distance), with the result that this printing control method is effective only when the carriage travels at a constant speed. In other words, in the prior-art printer, the printing operation is not executed during acceleration or deceleration as immediately after the carriage starts traveling or immediately before the carriage is stopped.

According to the prior-art printing method, it has been necessary to prepare marginal sections over the entire length of the printer for accelerating or decelerating the carriage, and therefore the space efficiency is reduced by that amount. Further, the throughput is decreased because no printing operation is executed during the carriage acceleration and deceleration.

Accordingly, the object of the present invention is to enable a high precise printing without being subjected to the influence of carriage speed, by precisely determining the printing timing even when the carriage travels at non-constant speed as when being accelerated and decelerated.

DISCLOSURE OF THE INVENTION

The present invention provides a printing control system for deciding printing timings at printing positions when a carriage is traveling in accordance with a designated printing density, which comprises: timer means for generating time information indicative of current time; speed information forming means for forming speed information related to the latest travel speed of the carriage; time estimating means for estimating time at which the carriage arrives at each printing position on the basis of the speed information formed by said speed information forming means; and printing timing deciding means for deciding each printing timing at the time when the current time of said timer means matches the estimated time.

According to the present invention, it is possible to decide the printing timing even when the carriage is traveling in the acceleration and deceleration sections Further, in the preferred embodiment of the present invention, the distance unit is determined so that the printing density is equal to the common multiple of the printing density and the positional pulse density, and the respective printing positions are grasped on the basis of the distance unit. Therefore, it is possible to allow the printing system to be applicable to a plurality of different printing densities.

BEST MODE FOR EMBODYING THE INVENTION

Figure 1:
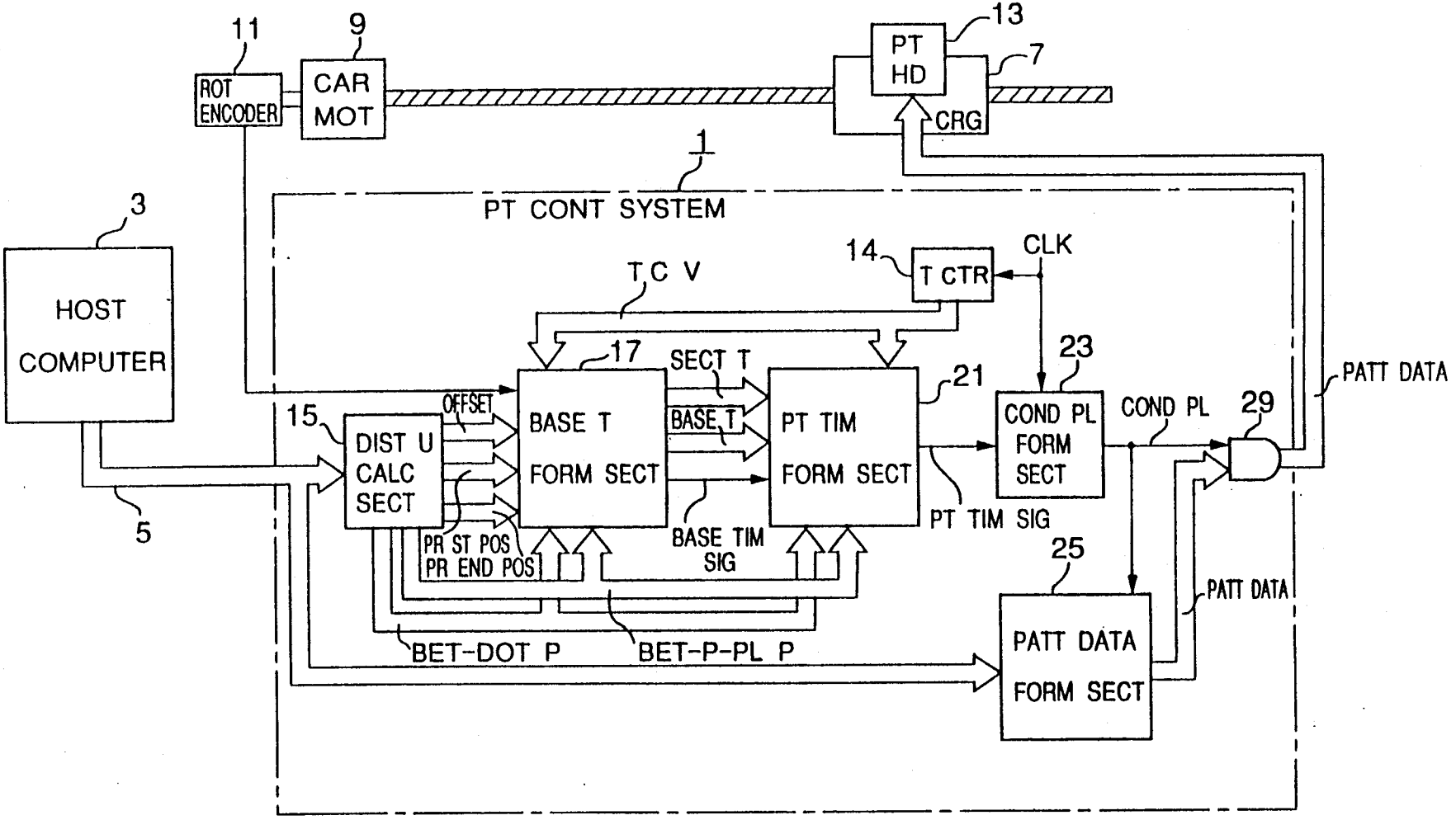
FIG. 1 is a block diagram showing an entire system configuration of an embodiment of the printing control system according to the present invention.

FIG. 1 shows an entire configuration of a preferred embodiment of the printing control system according to the present invention.

The printing control system 1 is connected to a bus 5 of a host computer 3, and receives various instructions such as printing density, printing start position and printing end position for each line, characters and symbols to be printed, etc., from the host computer 3. In this embodiment, the printing density is given as the number of dots per inch (DPI), and the designable printing densities are three kinds of 90, 120, and 240DPIs. Further, the printing start and end positions are given as the number of dots counted from a predetermined reference position of a carriage 7, respectively.

The printing system 1 receives position pulses generated whenever a printing head 13 reaches predetermined positions spaced apart at regular intervals, from a rotary encoder 11 mounted on a carriage motor 9, when the carriage is traveling. In this embodiment, the density of the position pulses generated per inch (PPI) is 120 PPI.

On the basis of this inputted information, the printing control system 1 determines the printing timing (i.e. the conduction timing of the printing head 13) for each dot, and provides a pattern data indicative of a pattern to be printed to the printing head 13 in accordance with the determined timing. To determine the printing timing, the position pulse given from the encoder 11 is used as the major decision standard. Since the density of the position pulse is 120 PPI as described above, when the printing density of 120 PPI the same as the position pulse density is designated, the positional relationship between the position at which each position pulse is generated and the position at which each printing is performed is always kept constant. However, when the printing density different from the position pulse density (e.g. 90 or 240 PPI) is designated, an offset is produced between the position at which each position pulse is generated and the position at which each printing is performed, and the produced offset varies periodically. This periodic time is referred to as base timing period, hereinafter. This period can be represented by the number of pulses or the number of dots obtained by dividing the density by a greatest common measure of the position pulse density and the printing density, in practice. To cope with the case where the printing density different from the position pulse density is designated as described above, this printing control system 1 stores a difference in distance between the position at which the position pulse is generated just prior to the printing start position and the printing start position, as an offset value; decides the first printing timing at each base timing period on the basis of the position pulse just prior to the printing start position and the time required when the carriage travels through the offset distance; and decides the second and after printing timings on the basis of the first printing timing and the time required when the carriage travels a pitch between the respective dots In this case, in order to enable the printing timing to be decided at the carriage acceleration and deceleration sections, the times required when the carriage travels the offset and the pitch between the respective dots are calculated always in accordance with the latest travel speed of the carriage Further, this printing control system 1 can control bi-directional printing operation (i.e. printing is performed whenever the carriage 7 goes and returns) That is, since a delay time exists between the conduction of the printing head 13 and the practical printing, this delay time inevitably results in a difference in printing positions between when the carriage travels in the going direction and when in the returning direction in the case of the bi-directional printing operation. To overcome this problem, in this printing control system 1, the position offset value corresponding to the delay time is stored as a correction value of the bi-directional printing, and the printing timing is generated earlier by this correction value so that the printing position in the going direction matches that in the returning direction. The precision of the correction value in the bi-directional printing (i.e. bi-directional printing precision) is previously determined by the of the steps per inch (SPI), which is 720 SPI in this embodiment.

As shown in FIG. 1, the printing control system 1 comprises a time counter 14, a distance unit calculating section 15, a base time forming section 17, a printing timing forming section 21, a conduction pulse forming section 23, and a pattern data forming section 25, as the major composing elements.

The time counter 14 receives a reference clock CLK having a sufficiently high frequency from an oscillator (not shown), and generates time count values indicative of the current time. The time count values are given to the base time forming section 17 and the printing timing forming section 21.

The distance unit calculating section 15 is provided with various functions as follows (a) for deciding the distance unit used as a unit when each printing position is decided on the basis of the printing density (90, 120, or 240 DPI) designated by the host computer 3, the position pulse density (120 PPI) and the bi-directional printing precision (720 SPI) both previously stored; (b) for generating data of the distance pitch between the dots (referred to as between-dot pitch, hereinafter) and the distance pitch between the position pulses (referred to as between-position-pulse pitch, hereinafter), represented by the number of the above-mentioned distance units, respectively and transmitting these data to the base time forming section 17 and the printing timing forming section 21; (c) for calculating the numbers of the position pulses between the above-mentioned reference position of the carriage and the printing start and end positions, and transmitting these data to the base time forming section 17; and (d) for calculating the offset value as the number of the distance units and transmitting this to the base time forming section 17.

The base time forming section 17 receives the time count value from the time counter 14, the position pulse from the rotary encoder 11, and the above-mentioned various data from the distance unit calculating section 15. The base time forming section 17 is provided with various functions as follows: (a) for calculating the time required when the carriage travels the between-position-pulse pitch at the latest carriage travel speed (referred to as section time, hereinafter) on the basis of the generation timing of each position pulse and the time count value; (b) for calculating the first printing timing at each base timing period represented by the above-mentioned time count value (referred to as base time, hereinafter); and (c) for generating the base timing signal representative of the start of each base timing period. This section time signal, base time and base timing signals are transmitted to the printing timing forming section 21.

The printing timing forming section 21 is provided with functions as follows: (a) for deciding the first printing timing at each base timing period on the basis of the base time from the base time forming section 17; and (b) for calculating the time required when the carriage travels the between-dot pitch (referred to as between-dot time) on the basis of the section time from the base time forming section 17 and for deciding the second and after printing timings at each base timing period by the use of the between-dot time. The printing timing forming section 21 generates printing timing signals in accordance with the decided printing timing, and the generated printing timing signals are given to the conduction pulse forming section 23.

The conduction pulse forming section 23 generates a conduction pulse having a constant pulse width in synchronism with the printing timing signal. The generated conduction pulse is given to the pattern data forming section 25, and further to an AND gate 29 so that the gate 29 is opened.

The pattern data forming section 25 is provided with functions as follows: (a) for having a ROM (not shown) is which dot patterns of various characters and symbols are previously stored, reading dot patterns of the designated characters and symbols from the ROM is response to a designation from the host computer 3, and storing the read patterns to a built-in image buffer (not shown); and (b) for reading the pattern data to be printed at the timing of the conduction pulse from the image buffer in response to an up-edge of the conduction pulse and transmitting the read data to the AND gate 29. Further, the pattern data forming section 25 can be configured in the conventional way, and therefore the detailed description thereof is omitted herein.

The AND gate 29 is kept open only when the conduction pulse is kept applied thereto to pass the above-mentioned pattern data. The pattern data are applied to the printing head 13 as the output data of the printing control system 1.

The configuration of the printing control system 1 will be described in more detail hereinbelow.

Figure 2:
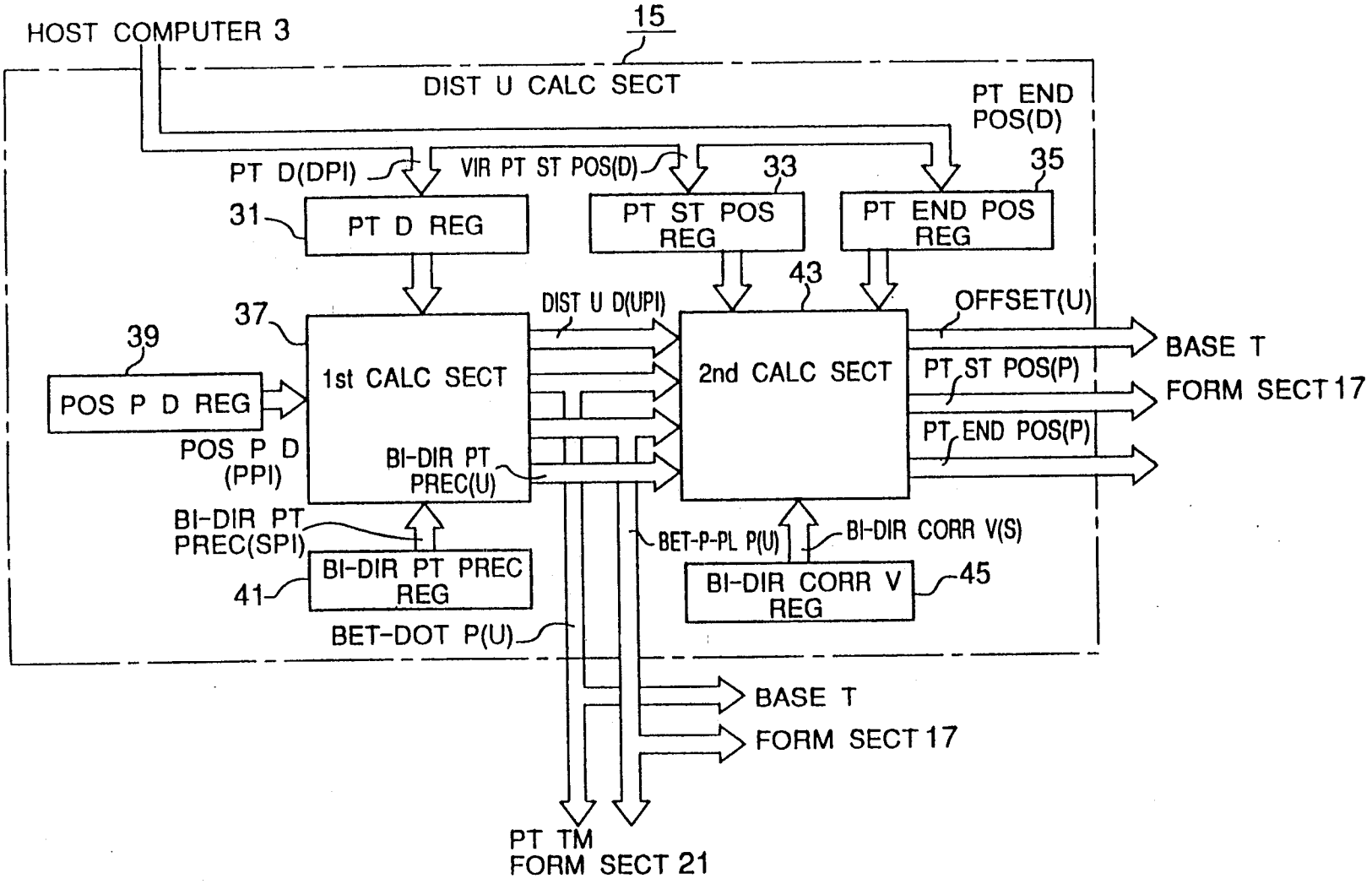
FIG. 2 is a more detailed block diagram showing the distance unit forming section shown in FIG. 1.

FIG. 2 shows the internal configuration of the distance unit calculating section 15.

In the drawing, printing densities of three kinds (90, 120, and 240 DPI) are previously registered in a printing density register 31. Prior to the printing start, a printing density selecting information is given from the host computer 3 to the printing density register 31, and one printing density corresponding thereto is outputted therefrom. In addition, printing start and end positions are given from the host computer 3 to a printing start position register 33 and a printing end position register 35 and stored herein. To facilitate understanding of the invention, the operation will be described on the conditions that a designated printing density is 90 DPI and a designated printing start position is 20 dots (D), for instance.

The printing density (90 DPI) stored in the printing density register 31 is inputted to a first calculating section 37. This first calculating section 37 also receives a position pulse density (120 PPI) and a bi-directional printing precision (720 SPI) both previously stored in two registers 39 and 41 as fixed values. This first calculating section 37 first calculates a least common multiple of the printing density, position pulse density, and bi-directional printing precision to decide the calculated multiple as a distance unit density per inch (UPI). In other words, 720 UPI can be obtained as the distance unit density Thereafter, the first calculating section 37 calculates a between-dot pitch, a between-position-pulse pitch, and a bi-directional printing precision all represented by the number of distance units, by dividing the distance unit density (720 UPI) by the printing density (90 DPI), the position pulse density (120 PPI) and the bi-directional precision (720 SPI), respectively. That is, eight units (U) can be obtained as the between-dot pitch; six units (U) can be obtained as the between-position-pulse pitch; and one unit (U) can be obtained as the bi-directional printing precision. These calculated distance unit density, between-dot pitch, between-position-pulse pitch, and bi-directional printing precision are all given to a second calculating section 43. Further, the between-dot pitch and the between-position-pulse pitch are additionally given to the base time forming section 17 and the printing timing forming section 21.

The second calculating section 43 further receives a bi-directional printing correction value from a register 45 as a fixed value. Here, five steps (S) is decided as the bi-directional printing correction value, for instance.

The second calculating section 43 first obtains a printing start position (160 U) represented by the number of the distance units by multiplying the printing start position (20) from the register 33 by the between-dot pitch (8 U) from the first calculator 37. In addition, the bi-directional printing correction value (5 U) represented by the number of the distance units can be obtained by multiplying the bi-directional printing correction value (5 S) from the register 45 by the bi-directional printing precision (1 U) represented by the number of the distance units and given from the first calculating section 37. Thereafter, a printing start position (155 U) corrected in the bi-directional printing is obtained by subtracting the bi-directional printing correction value (5 U) from the printing start position (160 U). The printing start position (155 U) thus corrected is referred to as the corrected printing start position, hereinafter. Further, the above-mentioned subtraction in the calculation of the corrected printing start position can be applied to only the case where the carriage travels in the going direction and therefore addition can be applied to the case where the carriage travels in the returning direction. Thereafter, the correction printing start position (155 U) is divided by the between-position-pulse pitch (6 U) from the first calculating section 37, and the obtained quotient (25 P) and remainder (5 U) are transmitted to the base time forming section 17, in which the quotient is used as the printing start position represented by the number of position pulses (i.e. the total number of pulses generated from when the carriage starts to travel to when reaches the corrected printing start position) and the remainder is used as the offset value, respectively.

Thereafter, the second calculator 43 executes the similar calculation for the printing end position from the register 35. The calculated printing end position represented by the number of position pulses is transmitted to the base time forming section 17.

Figure 3:
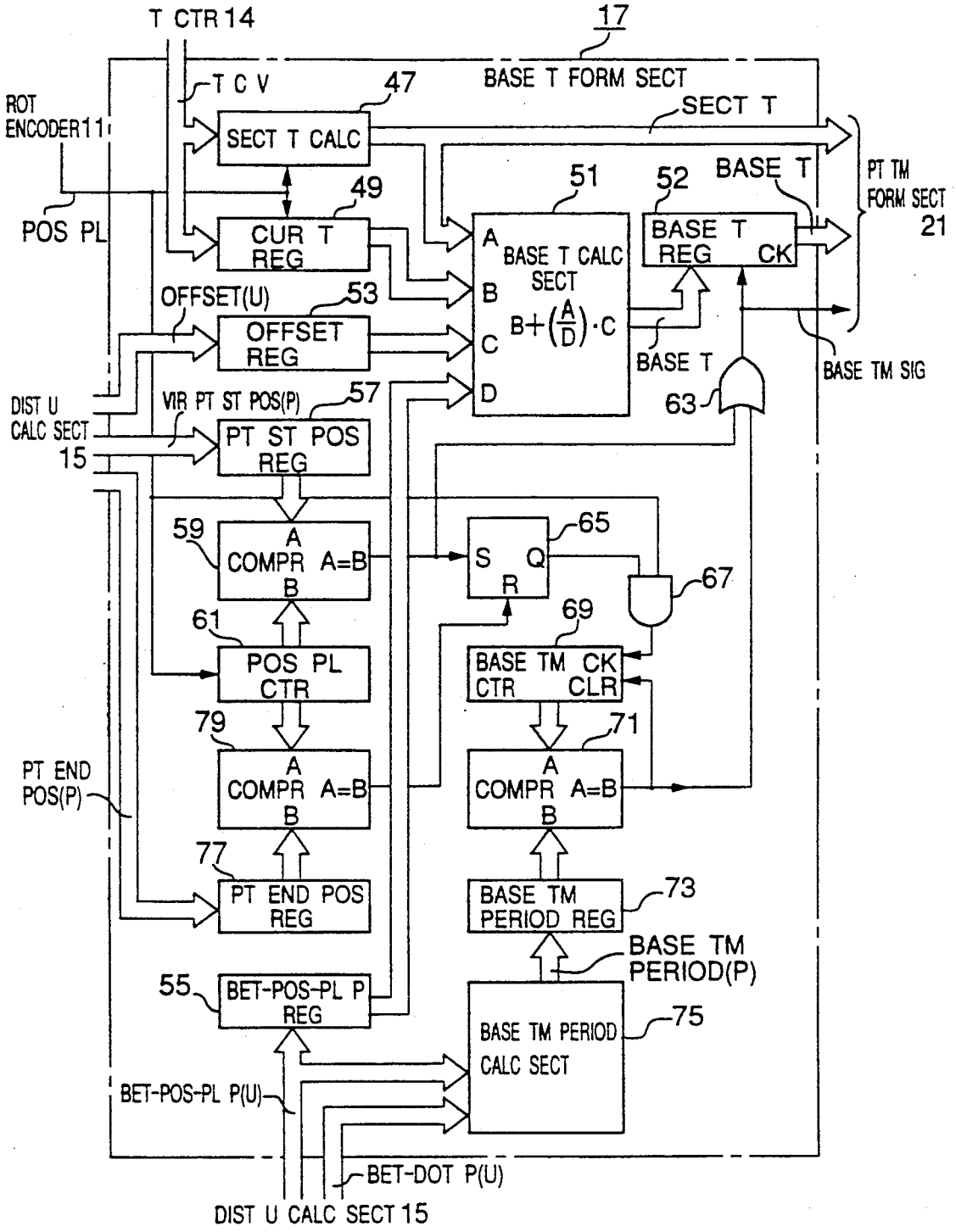
FIG. 3 is a more detailed block diagram showing the base time forming section shown in FIG. 1.

FIG. 3 shows a more detailed configuration of the base time forming section 17.

In the drawing, the time count value from the time counter 14 is applied to a section time calculator 47 and a current time register 49.

The section time calculator 47 receives the time count value in response to the position pulse from the rotary encoder 11, and calculates the latest section time (the latest period of the position pulse) by subtracting the preceding time count value from this time count value. Further, the current time register 49 receives the time count value in response to the position pulse This time count value represents the current time at which the position pulse is generated. These section time and current time are transmitted to a base time calculating section 51. Further, the section time is transmitted to the printing timing forming section 21

The offset (5 U) and the between-position-pulse pitch (6 U) from the distance unit calculating section 15 are stored in registers 53 and 55, and then given to the base time calculating section 51.

The base time calculating section 51 first obtains the required travel time per distance unit in accordance with the latest carriage travel speed, by dividing the section time by the between-position-pulse pitch. Thereafter, the base time calculating section 51 obtains the required travel time for the offset, by multiplying the offset represented by the number of the distance units by the required travel time per distance unit. Further, the obtained required travel time for the offset and the current time are added to obtain a base time (i.e. a time count value representative of the first printing timing in each base timing period). The obtained base time is applied to a base time register 52.

The virtual printing start position (25 P) from the distance unit calculating section 15 is stored in a register 57 and then applied to one input terminal of a comparator 59. To the other input terminal of the comparator 59, the count value of the position pulse is applied from a position pulse counter 61 composed of an up-down counters. The virtual printing start position (25 P) and the position pulse count value match each other at the time point of the position pulse just prior to the printing start position, at which the comparator 59 outputs a High-level match signal. This match signal is transmitted to the printing timing forming section 21 through an OR gate 63 as a base timing signal, and additionally to a clock terminal CK of the base time register 52. In response to this match signal, the base time from the base time calculating section 51 is stored in the base time register 52. This base time stored in the base time register 52 is transmitted to the printing timing forming section 21.

The match signal from the comparator 59 is also applied to a set terminal S of a flip-flop 65, so that this flip-flop 65 is set. Once the flip-flop 65 is set, the output signal Q thereof rises to a High-level to open an AND gate 67, so that the position pulse inputted from the rotary encoder 11 is kept applied to a clock terminal CK of base timing counter 69 through the AND gate 67. As a result, the base timing counter 69 starts counting the position pulses.

The count value of the base timing counter 69 is given to one input terminal of a comparator 71. To the other input terminal of the comparator 71, the base timing period stored in a register 73 is applied. The base timing period has been calculated by a base timing period calculating section 75 on the basis of the between position-pulse pitch (6 U) and the between-dot pitch (8 U), which is represented by the number (P) of the position pulses. In practice, the least common multiple (24 U) of the between-position-pulse pitch (6 U) and the between-dot pitch (8 U) is obtained, and then this least common multiple (24 U) is divided by the between-position-pulse pitch (6 U) to obtain the base timing period (4 P).

The count value of the counter 69 matches the base timing period (4 P) at the time point of the position pulse just prior to the start of each base timing period, so that the comparator 71 outputs a High-level match signal whenever both match each other. This match signal is transmitted to the printing timing forming section 21 as the base timing signal through the OR gate 63, and additionally to the clock terminal CK of the base time register 52. In response to this match signal, the base time from the base time calculating section 51 is stored in the base time register 52.

The printing end position from the distance unit calculating section 15 is once stored in a register 77 and then transmitted to a comparator 79, at which the transmitted printing end position is compared with the count value from the position pulse counter 61. When both match each other; that is, when the printing head reaches the printing end position, the comparator 79 transmits a High-level signal to a reset terminal R of the flip-flop 65. Therefore, the output signal Q of the flip-flop 65 drops to a Low-level to close the AND gate 67, and thus the counting operation of the base timing counter 69 stops.

Figure 4:
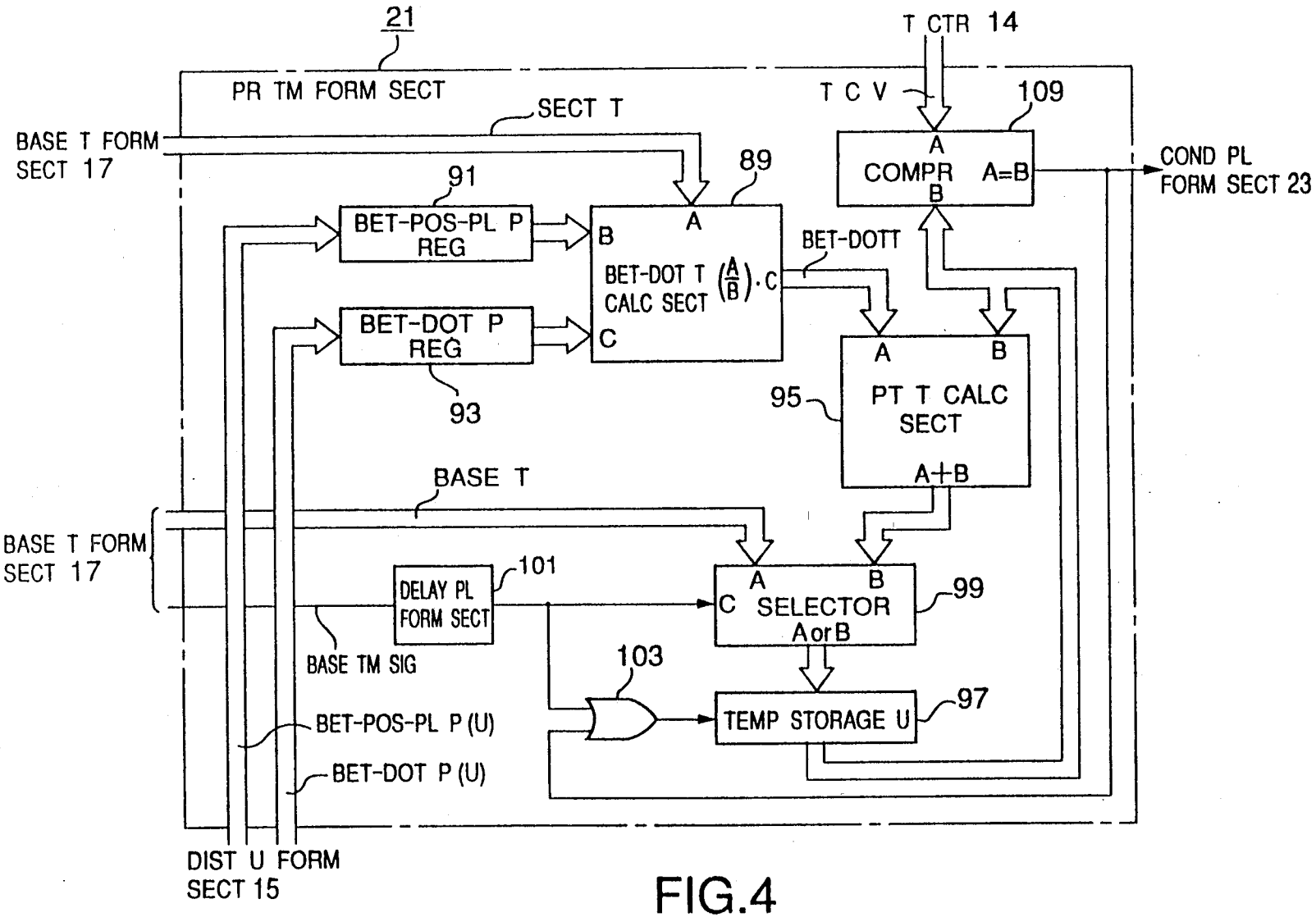
FIG. 4 is a more detailed block diagram showing the printing timing forming section shown in FIG. 1.

FIG. 4 shows a more detailed configuration of the printing timing forming section 21.

In the drawing, the section time from the base time forming section 17 is inputted to a between-dot time calculating section 89. Further, the between-position-pulse pitch (6 U) and the between-dot pitch (8 U) from the distance unit calculating section 15 are stored in registers 91 and 93, respectively, and then applied to a between-dot time calculating section 89. The between-dot time calculating section 89 calculates the required travel time per distance unit at the latest carriage travel speed by dividing the section time by the between-position-pulse pitch, and further calculates the required travel time (between-dot time) for the between-dot pitch by multiplying the calculated required travel time per distance unit by the between-dot pitch. The calculated between-dot time is transmitted to a printing time calculating section 95.

The printing time calculating section 95 adds the between-dot time from the between-dot time calculating section 89 to the data from a temporary storage unit 97. The data stored in the temporary storage unit 97 is the preceding printing time as described later, and the addition of the between-dot time to this data implies that the succeeding printing time is calculated.

The printing time calculated by the printing time calculating section 95 is applied to one input terminal B of a selector 99. Further, the base time from the base time forming section 17 is applied to the other terminal A of the selector 99. The selector 99 selects and passes either one of the inputted data in accordance with the level of the signal applied from a delay pulse forming section 101 to a control terminal C of the selector 99. The delay pulse forming section 101 generates a pulse signal having a short pulse width a little delayed from the up-edge of the base timing signal from the base time forming section 17, in response to the base timing signal. When being receiving the pulse signal from the delay pulse forming section 101, the selector 99 selects the base time. However, the selector 99 selects the printing time from the printing time calculating section 95 when not receiving the pulse signal from the delay pulse forming section 101. The data passed through the selector 99 is applied to the temporary storage unit 97. The temporary storage unit 97 holds the data passed through the selector 99 in synchronism with the pulse signal given from the delay pulse forming section 101 through an OR gate 103 and the printing timing signal outputted from the printing timing forming section 21, until the succeeding data can be received.

The base time or the printing time held by the temporary storage unit 97 is transmitted to a comparator 109, and compared with the time count value transmitted from the time counter 14. When the time count value matches the base time or the printing time, the comparator 109 outputs a High level pulse signal. This signal is transmitted to the conduction pulse forming section 23 as the printing timing signal.

Figure 5:
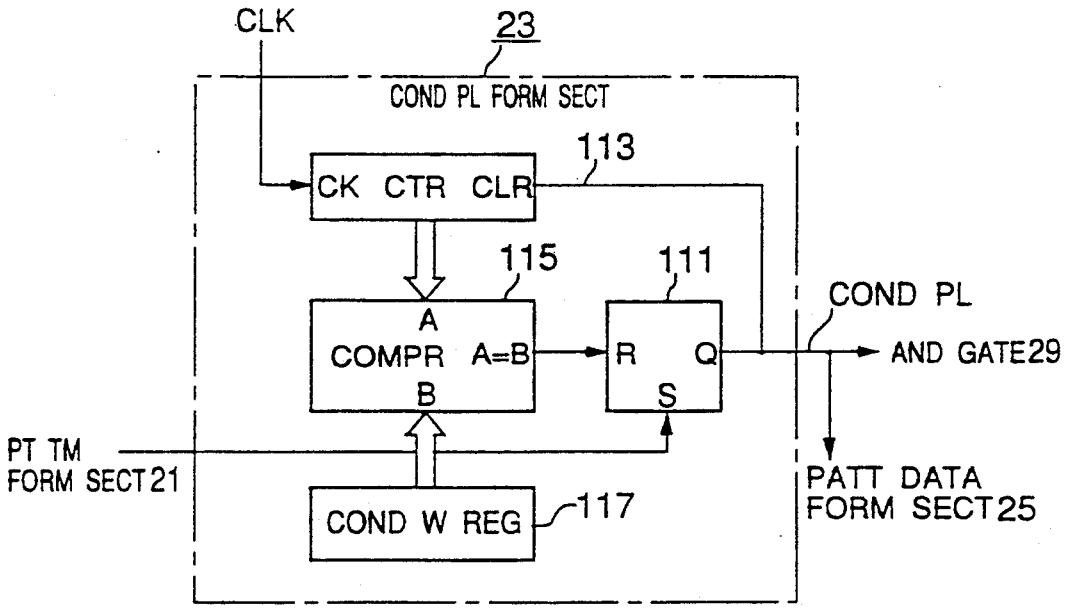
FIG. 5 is a more detailed block diagram showing the conduction pulse forming section shown in FIG. 1.

FIG. 5 shows a detailed configuration of the conduction pulse forming section 23.

In the drawing, the printing timing signal from the printing timing forming section 21 is applied to a set terminal S of a flip-flop 111, so that the output signal Q of the flip-flop 111 rises to a High-level. In response to the up-edge of this output signal Q, the counted value of a counter 113 is cleared out. The counter 113 always counts an inner clock CLK. Therefore, the counted value indicates the time elapsed after the counter 113 has been cleared. The counted value is transmitted to a comparator 115, and compared with a conduction width previously stored as a fixed value in a conduction width register 117. When both match each other, the comparator 115 outputs a High-level signal, so that the flip-flop 111 is reset in response to the up-edge of this High-level signal and the level of the output signal Q drops to a Low-level. As described above, the output signal Q of the flip-flop 111 forms a conduction pulse having the same pulse width as the above-mentioned conduction width in synchronism with the printing timing signal. The formed conduction pulse is transmitted to the AND gate 29 and the pattern data forming section 25. As a result, the printing head executes printing in synchronism with the printing timing signal.

Figure 6:
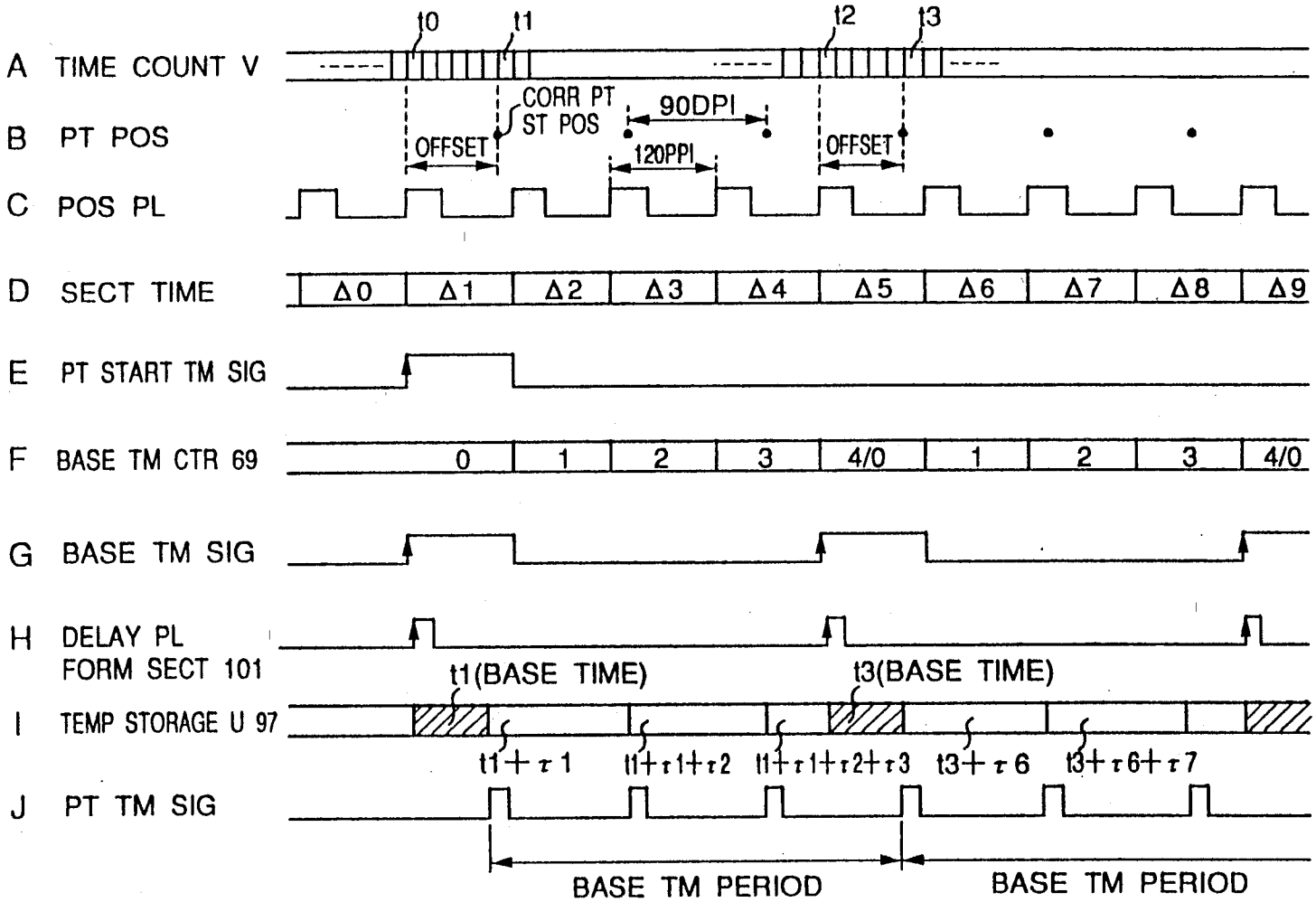
FIG. 6 is a timing chart for assistance in explaining the operation of the embodiment shown in FIG. 1.

FIG. 6 shows a signal timing chart for assistance in explaining the operation of the present invention. The respective dots shown in B of FIG. 6 indicate each printing position after having corrected by the bi-directional printing correcting value, and the leftmost dot indicates the corrected printing start position. The difference in distance between the corrected printing start position and the preceding position pulse is an offset value. This offset value is previously calculated and stored.

Whenever the position pulse is generated, the section time is calculated as Δ0, Δ1, Δ2, ....(D of FIG. 6). Further, the base time is calculated as a value obtained by adding the above-mentioned required offset travel time on the basis of the latest section time to the current time at which the position pulse is generated. For instance, at the time point when the position pulse is generated just prior to the corrected printing position, the time t1 obtained by adding the required offset travel time on the basis of the latest section time Δ0 to the current time t0 can be obtained as the base time (A of FIG. 6).

The printing start timing signal is generated at the time point when the position pulse is generated just prior to the corrected printing position (E of FIG. 6), and this printing start timing signal becomes the base timing signal (G of FIG. 6). In response to the up-edge of this base timing signal, the delay pulse forming section 101 generates a pulse signal (H of FIG. 6), and the base time t1 at this time point is stored in the temporary storage unit 97 in synchronism with this pulse signal (I of FIG. 6). Further, when the time count value (A of FIG. 6) matches the base time t1 the first printing timing signal is outputted (J of FIG. 6).

In synchronism with this first printing timing signal, the succeeding printing time $t1+\tau1$ calculated by the printing time calculating section 95 (see FIG. 4) is stored in the temporary storage unit 97 (I of FIG. 6). This printing time is the value obtained by adding the between-dot time $\tau1$ on the basis of the latest section time $\tau1$ to the base time t1 of the preceding printing time. Further, when this printing time $t1+\tau1$ matches the time count value, the second printing timing signal is generated.

In synchronism with this second printing timing signal, the next printing time $t1+\tau1+\tau2$ is stored in the temporary storage unit 97. This printing time $t1+\tau1+\tau2$ is a value obtained by adding the between-dot time $\tau2$ on the basis of the latest section time Δ2 to the preceding printing time $t1+\tau1$. When the time count value matches this printing time $t1+\tau1+\tau2$, the third printing timing signal is generated.

In synchronism with the third printing timing signal, further the next printing time $t1+\tau1+\tau2+\tau3$ is stored in the temporary storage unit 97. However, at the time point of the succeeding position pulse, the count value of the base timing counter 69 reaches the base timing period 4 (F of FIG. 6), so that the base timing signal is generated again (G of FIG. 6). This implies that another new base timing period starts just now. In response to the generation of this base timing signal, the latest base time t3 is written in the temporary storage unit 97, instead of the previously written printing time $t1+\tau1+\tau2+\tau3$. This base time t3 is a value obtained by adding the required offset travel time on the basis of the latest section time Δ4 to the current time t2 at which the position pulse is generated. When the time count value reaches this base time t3, the first printing timing signal of this new base timing period is outputted.

The second and third printing timing signals following this signal are generated in accordance with the values obtained by adding the between-dot time to the preceding printing time, in the same way as with the case of the first base timing period.

As described above, at each base timing period, the first printing timing can be decided on the basis of the base time, and the second and after printing timings can be decided on the basis of addition of the preceding printing time and the between-dot time. In this case, the base time and the between-dot time are calculated on the basis of the latest section time, that is, on the basis of the latest carriage travel speed, with the result that it is possible to decide a high precious printing timing even at the carriage acceleration or deceleration sections.

The operation of the embodiment of the present invention has been described by taking the case where the printing density is 90 DPI. Without being limited thereto, however, it is of course possible to obtain a high precious control of the printing operation even if the printing density is 120 or 240 DPI.

Another embodiment of the present invention will be described hereinbelow.

Figure 7:
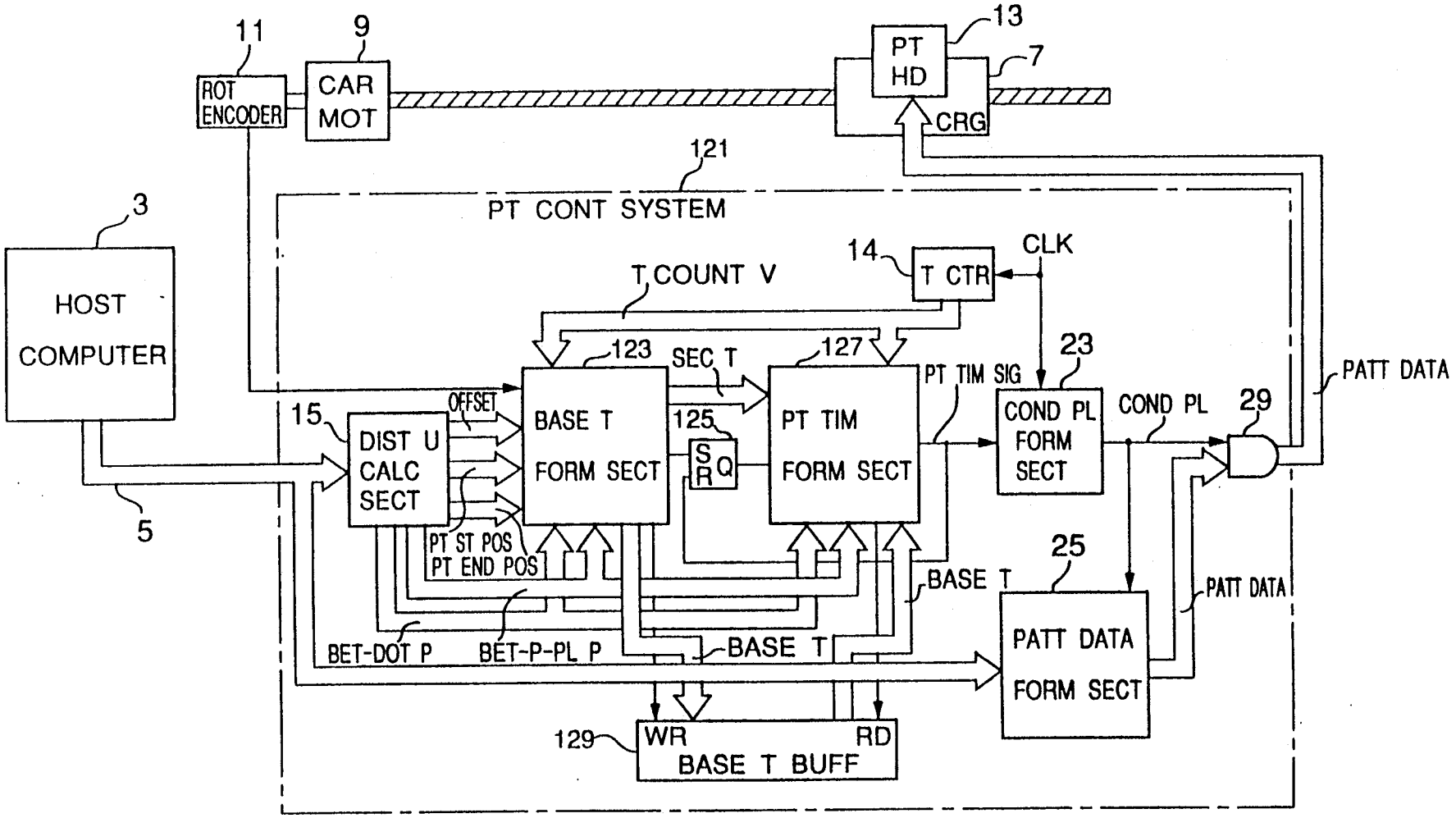
FIG. 7 is a block diagram showing an entire configuration of another embodiment of the present invention.

In this embodiment, at least the base time and printing time are calculated by a computer. FIG. 7 shows an entire functional configuration. In the drawing, the same reference numerals have been retained for the similar sections or elements having the same functions as in FIG. 1.

Figure 8:
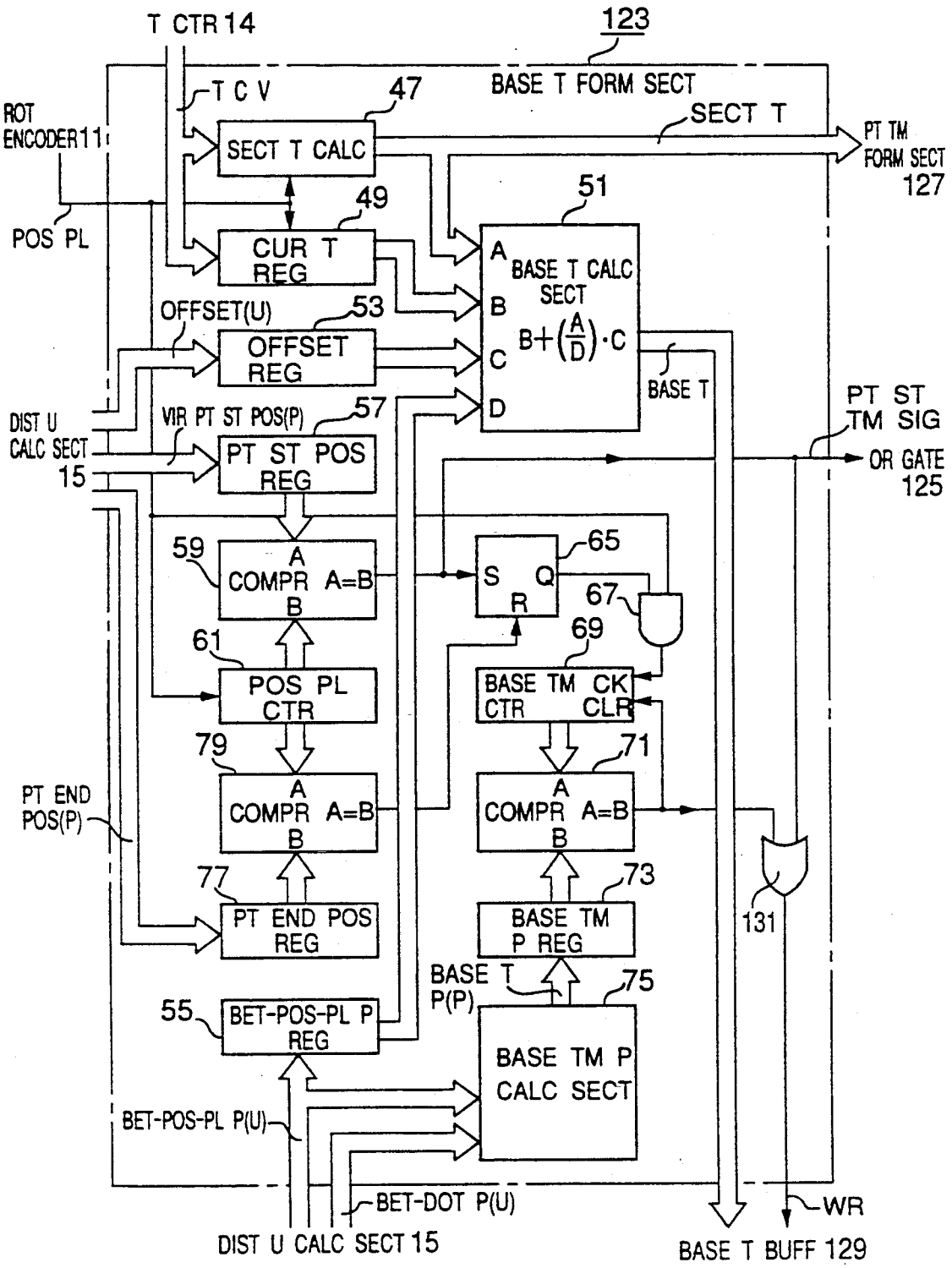
FIG. 8 is a block diagram showing the base time forming section shown in FIG. 7.
Figure 9:
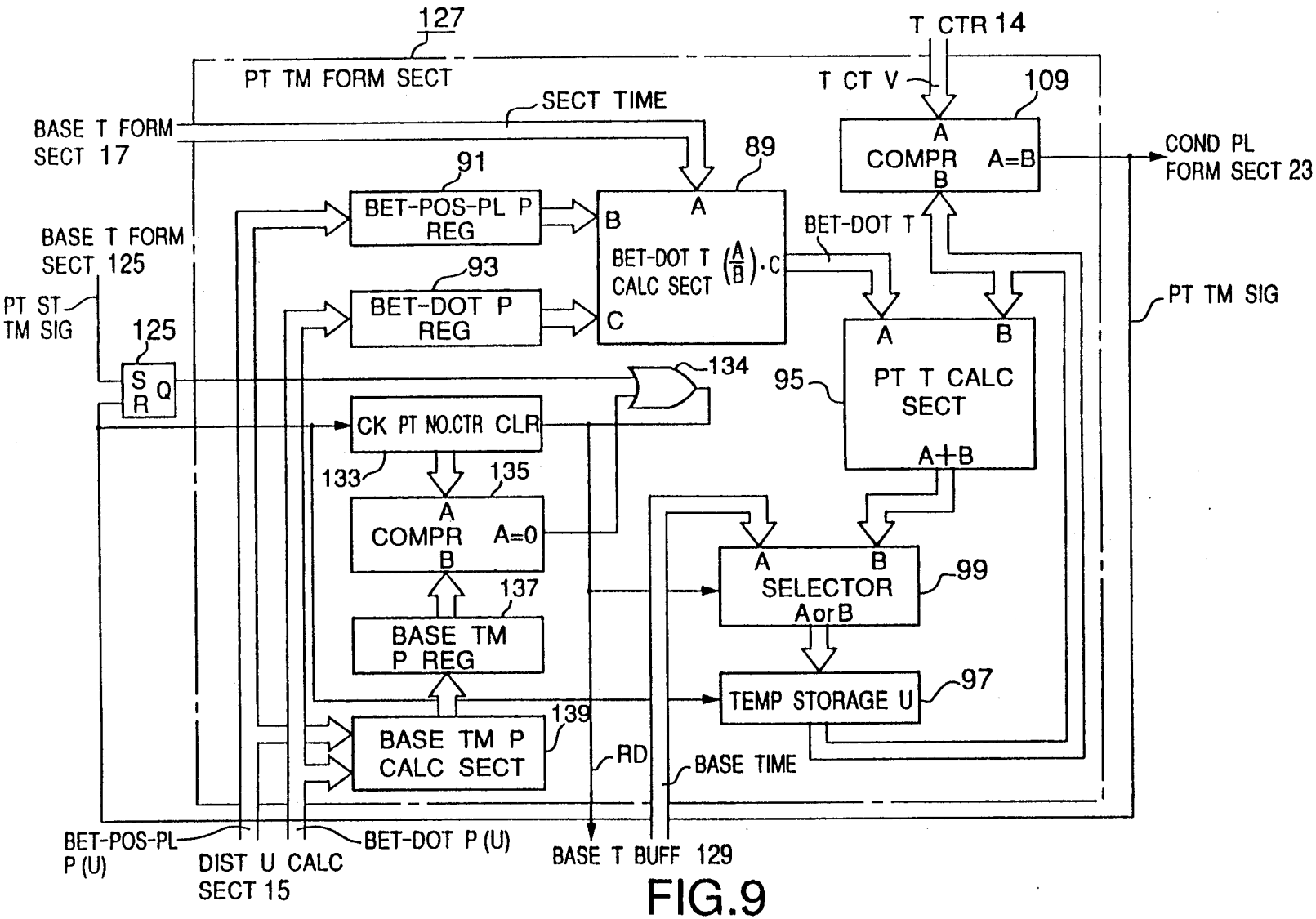
FIG. 9 is a block diagram showing the printing timing forming section shown in FIG. 7.

In the embodiment shown in FIG. 7, at least the base time forming section 123, the flip-flop 125 and the printing timing forming section 127 are realized by a programmed computer. The detailed functional configuration of this base time forming section 123 and the printing timing forming section 127 are shown in FIGS. 8 and 9. In these figures, the same reference numerals as in FIGS. 3 and 4 have been retained.

Figure 11:
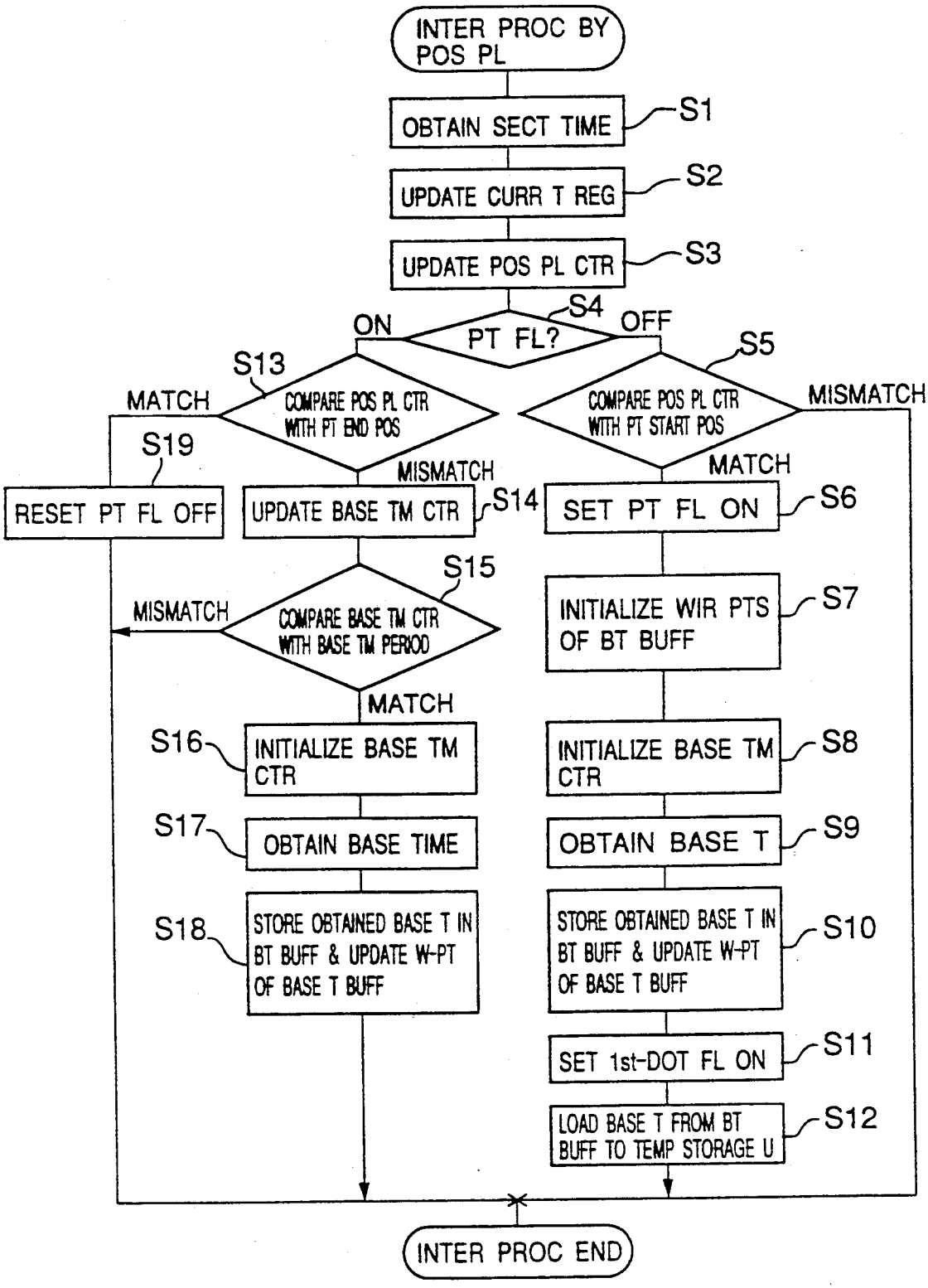
FIG. 11 is a flowchart for assistance in explaining the base time calculation processing in the embodiment shown in FIG. 7.

The calculating processing of the base time is executed within the base timing forming section 123 as the interrupt processing of the position pulse, in accordance with the flowchart shown in FIG. 11. Further, the calculating processing of the printing time is executed within the printing timing forming section 127 as the interrupt processing of the printing timing signal, in accordance with the flowchart shown in FIG. 12.

Figure 10:
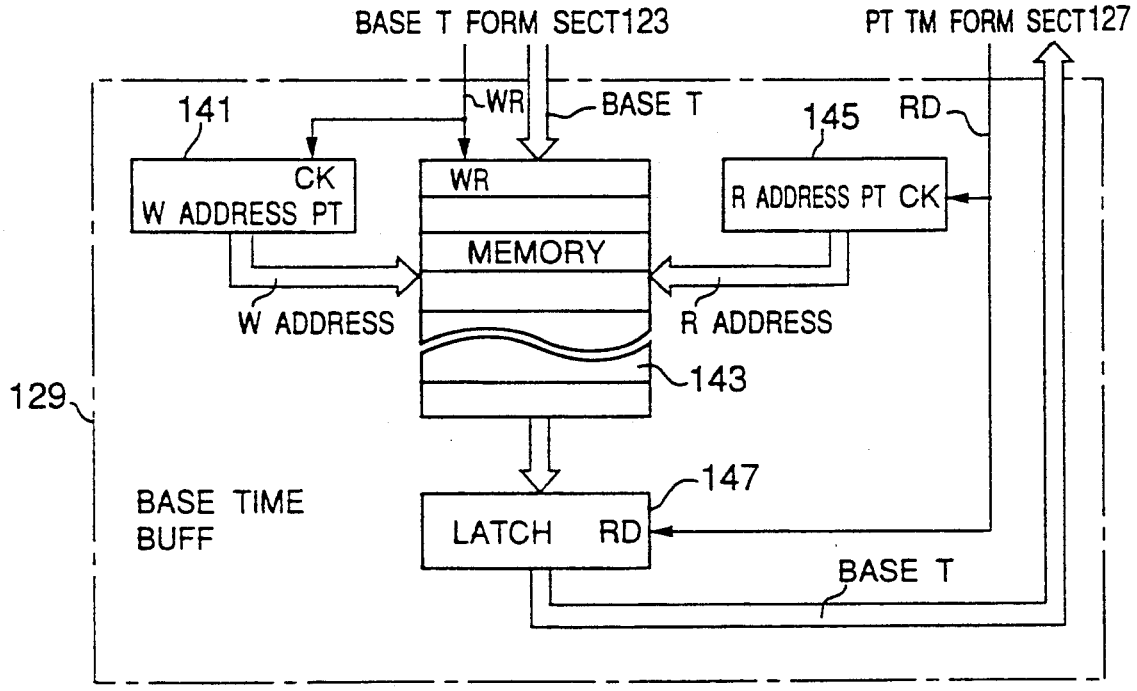
FIG. 10 is a block diagram showing the base time buffer shown in FIG. 10.
Figure 12:
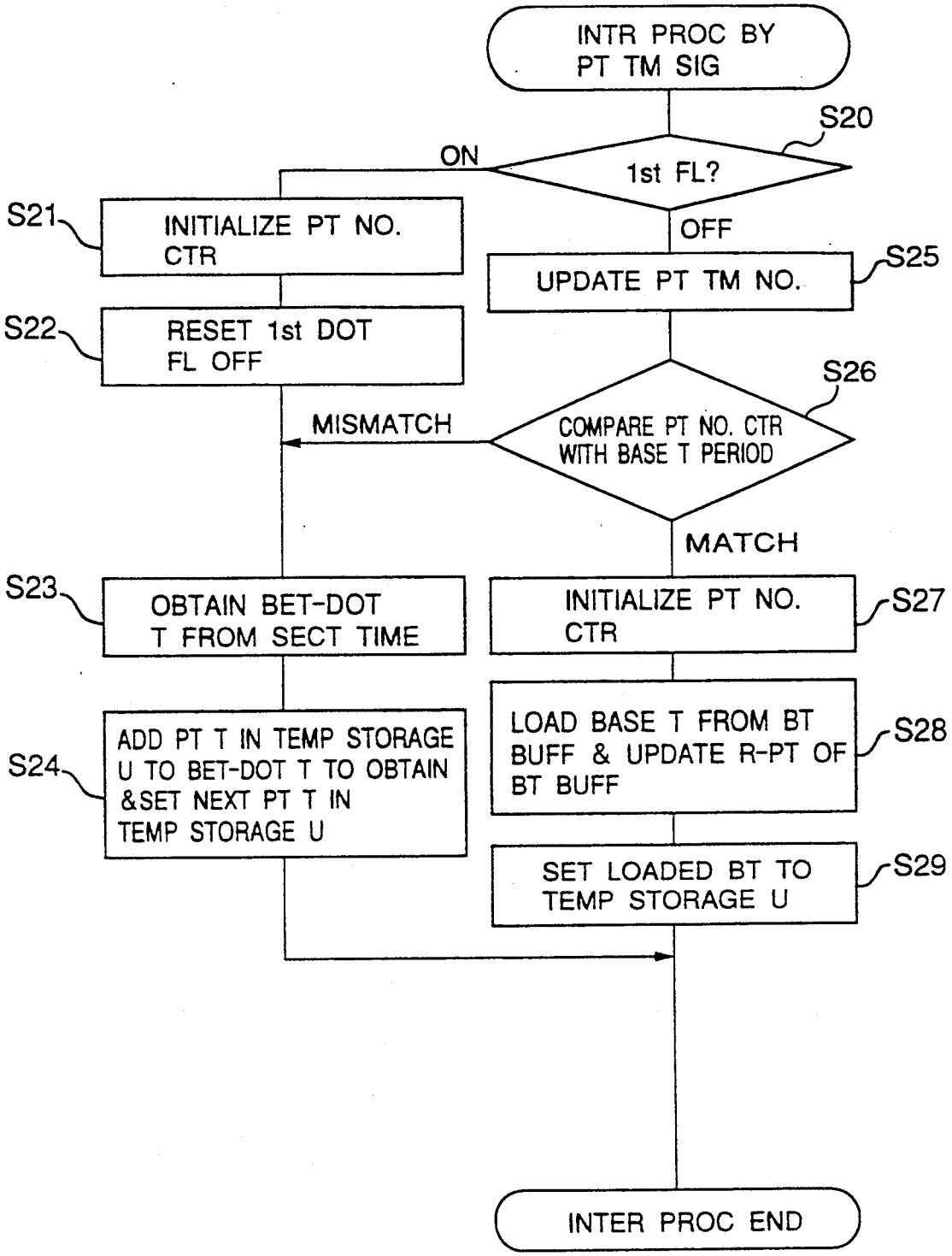
FIG. 12 is a flowchart for assistance in explaining the printing time calculation processing in the embodiment shown in FIG. 7.

The base time calculated by the interrupt processing shown in FIG. 11 is also utilized for the succeeding interrupt processing shown in FIG. 12. Therefore, a buffer as shown in FIG. 7 is required for temporarily storing the calculated base time. The detailed configuration of this base time buffer 129 is shown in FIG. 10.

The base time calculating processing will first be described hereinbelow with reference to FIG. 8 and the flowchart shown in FIG. 11.

In response to the position pulse, first the section time is calculated; the current time register 49 is updated; and the position pulse counter 61 is updated (in steps S1, S2, and S3). Thereafter, a printing flag indicative of whether the printing is being executed or not (corresponding to the status of the flip-flop 65) is checked (in step S4).

If the printing flag is off (corresponding to the reset status of the flip-flop 65), the printing is not being executed. In this case, the count value of the position pulse counter 61 is compared with the printing start position (in step S5). If both do not match, since this indicates that the head does not yet reach the virtual printing start position, nothing is executed at this moment, ending the interrupt processing. If both match, since this indicates that the head just reaches the virtual printing start position, the printing flag is set on (corresponding to the set status of the flip-flop 65); a write-in address pointer 141 and a read-out address pointer 145 of the base time buffer 129 are initialized; the base timing counter 71 is initialized; and the base time is calculated (in steps S6, S7, S8, and S9). Subsequently, the obtained base time is given to the base time buffer 129 together with a write-in instruction WR, to write the base time to the memory section 143, and then the write-in address pointer 141 is updated (in step S10). Further, the first dot flag is set on (corresponding to the set status of the flip-flop 125), and the preceding base time is read out of the base time buffer 129 and then stored in the temporary storage unit 97 shown in FIG. 9, ending the interrupt processing (in steps S11 and S12). Thereafter, if the base time within the temporary storage unit 97 matches the time count value from the time counter 14, the first printing timing signal is outputted.

In the case where the printing flag is set on in the above step S4 (the set status of the flip-flop 65), this indicates that the printing is being executed. Therefore, the count value of the position counter 61 is compared with the printing end position (in step S13). If both do not match, this indicates that the head does not yet reach the printing end position. In this case, after the base time counter 69 has been updated, the count value of the base time counter 69 is compared with the base timing period (in steps S14 and S15). If both match, the base timing counter 69 is initialized and the base time is calculated (in steps S16 and S17). Further, the obtained base time is written into the base time buffer 129 and the write-in address pointer 119 is updated (in step S18), ending the interrupt processing.

If both do not match in step S14, nothing is executed, ending the processing.

If the value of the position pulse counter 61 matches the printing end position in step S12, since this indicates that the printing ends, the printing flat is reset off (corresponding to the reset status of the flip-flop 65) (in step S19), ending the interrupt processing.

The printing time calculating processing will be described hereinbelow with reference to FIGS. 12 and 9.

When the printing timing signal is generated, first the first dot flag (the status of the flip-flop 125) is checked (in step S20). If the first flag is set on (the set status of the flip-flop 125), this indicates that the first dot has been just printed. In this case, the printing number counter 133 is initialized; and the first dot flag is set off (the flip-flop 125 is reset) (in steps S19 and S20). Subsequently, the between-dot time is calculated on the basis of the section time; the succeeding printing time is calculated by adding this between-dot time to the printing time within the temporary storage unit 97 (in this case, the first base time); and the calculated printing time is stored in the temporary storage unit 97 (in steps S23 and S24). Thereafter, when the printing time stored in the temporary storage unit 97 matches the time count value, the printing timing signal is outputted.

If the first dot flag is reset off in the above step S20 (the reset status of the flip-flop 125), after the count value of the printing number counter 133 has been updated, the count value is compared with the base timing period (in steps S25 and S26). If both do not match, afore-mentioned processing of steps S23 and S24 is executed.

If both match in step S26, this indicates that the succeeding dot is the first dot within the base timing period. In this case, the printing number counter is first initialized (in step S27), and then a read signal RD is transmitted to the base time buffer 129 to load the base time. Further, the read-out address pointer 145 within the base time buffer 129 is updated (in step S28) and the loaded base time is set to the temporary storage unit 97 (in step S29). Subsequently, when the base time within the temporary storage unit 97 matches the time count value, the printing timing signal is outputted.

In the present embodiment, it is preferable to use an NEC-made μPD 78322 as the CPU for the computer. This is because this CPU is provided with hardware suitable for time calculation processing and the therefore the processing speed is high. In more detail, the abovementioned μPD 78322 is provided with a 16-bit free-running timer always operating in response to a clock signal; several 16-bit capture registers for latching the output signal of this free-running timer in synchronism with an external capture command signal; several 16-bit compare registers for comparing the output signal of the free-running timer with any given values generated within the CPU; and several flip-flops set or reset in response to the output signals of these compare registers, as hardware.

Figure 13:
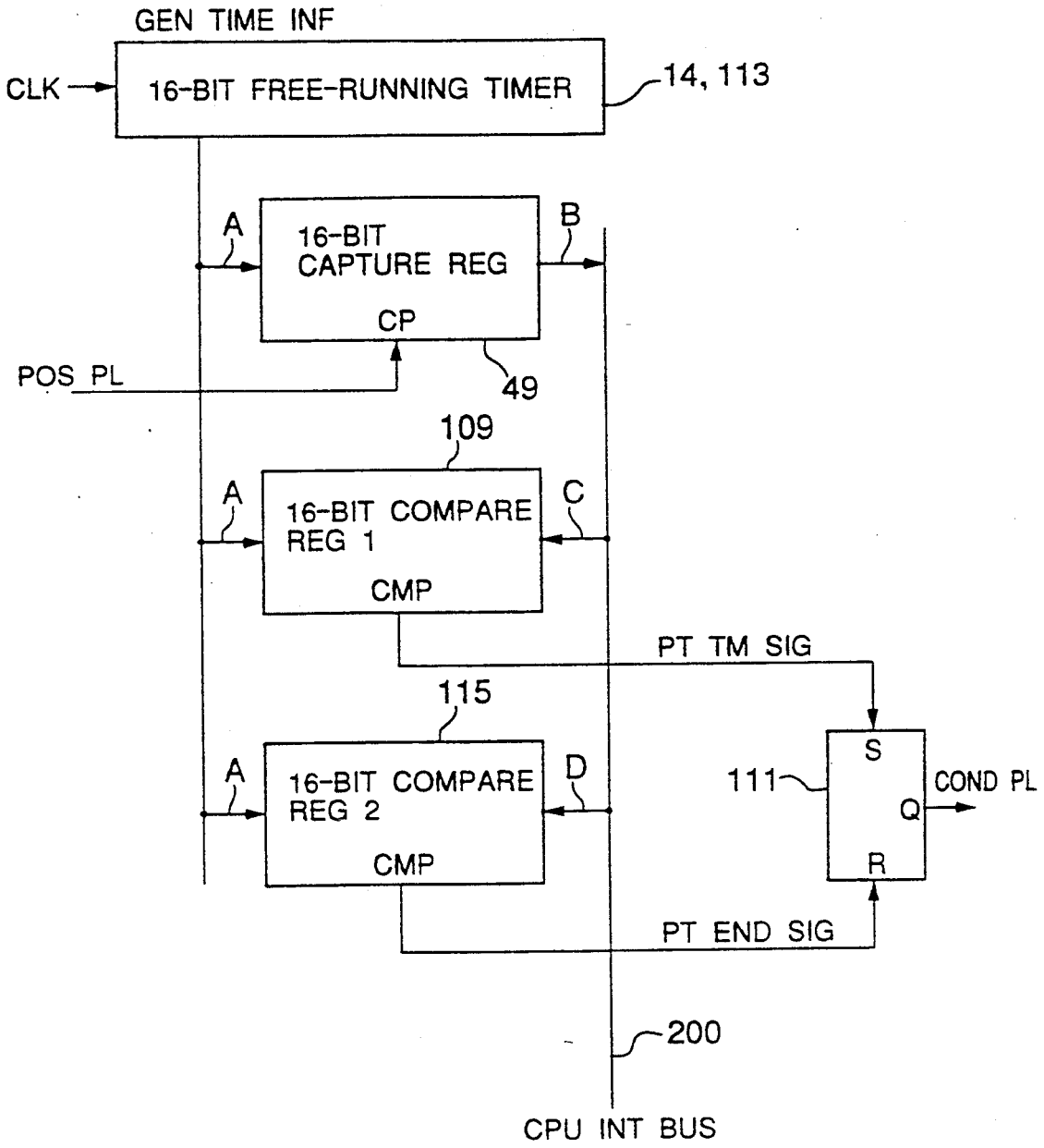
FIG. 13 is an illustration for assistance in explaining an example of utilization mode of CPU hardware elements when an NEC-made μPD 78322 is used as the CPU of the computer in the embodiment shown in FIG. 7.

FIG. 13 shows an example of utilization mode of the hardware elements when the μPD 78322 is adopted for the above-mentioned embodiment.

In FIG. 13, the free-running timer is used as the time counter 14 shown in FIG. 7 and the counter 113 shown in FIG. 5, which outputs the current time information A in response to the reference clock CLK. The capture register is used as the current time register 49 shown in FIG. 8, which receives the position pulse as a capture command signal CP and latches the current time information A from the free-running timer 14 in synchronism with this command signal CP. The time information B latched by the capture register 49 when the position pulse is generated is transmitted to another section (not shown) of the CPU operated in accordance with software, through a CPU internal bus 200, so as to be used to calculate the base time. The first compare register is used as the comparator 109 shown in FIG. 9, which compares the current time information A from the free-running timer 14 with the estimated time C at which the head reaches the respective printing positions (transmitted from the other section (not shown) within the CPU through the internal bus 200). When both match, the first compare register 109 outputs the printing timing signal. The second compare register is used as the comparator 115 shown in FIG. 5, which compares the time information A from the free-running timer 113 with an addition value D of the estimated arrival time C given from the other section of the CPU and the conduction time width, and outputs the printing end signal indicative of the conduction end time. The printing timing signal from the first compare register 109 sets the flip-flop 111, and the printing end signal from the second compare register 115 resets the flip-flop 111. The flip-flop 111 outputs the conduction signal from when set to when reset.

By utilizing the hardware elements of the CPU as described above, it is possible to reduce the processing amount depending upon the software and therefore improve the processing speed.

It is not to be understood that the present invention is limited to only the above-mentioned embodiments, and therefore the present invention can be modified into various modifications without departing from the spirits and the scope of the invention.

I claim:

1. A printing control system for deciding printing timings at printing positions when a carriage is traveling in accordance with a designated printing density, which comprises:

timer means for generating time information indicative of current time;

position detecting means for generating position pulses having a constant number of pulses per unit travel distance when the carriage is traveling;

speed information forming means for forming speed information related to the latest travel speed of the carriage, said speed information forming means receiving time information from said timer means whenever each position pulse is generated, and forming the speed information on the basis of the received time information;

means for deciding a distance unit so that a common multiple of a preselected printing density and the number of position pulses generated per unit length travel distance to generate a distance unit density as a number of distance units per unit length;

time estimating means for estimating time at which the carriage arrives at each printing position on the basis of the speed information formed by said speed information forming means, said time estimating means calculating a difference in distance between the selected position pulse and the printing position on the basis of the printing density and the number of position pulses generated per unit travel distance, and estimating the time at which the carriage reaches the printing position on the basis of the calculated distance difference and the speed information formed by said speed information forming means, said time estimating means utilizing the distance difference as the number of the distance units, obtains a required travel time of the distance unit on the basis of the speed information; calculates a required travel time of the distance difference on the basis of the obtained required travel time of the distance unit and the number of the distance units; and estimates the time at which the carriage reaches each printing position, as an addition of the required travel time of the distance difference and the time information from said time means at which the specific position pulses a regenerated; and printing timing deciding means for deciding each printing timing at the time when the current time of said timer means matches the estimated time.

2. The printing control system of claim 1, wherein said means for deciding a distance unit decides a common multiple of a previously determined bi-directional precision, the printing density, and the number of position pulses generated per unit length, as the density of the distance unit.

3. The printing control system of claim 2, wherein said time estimating means utilizes a previously determined bi-directional printing correction value as the number of the distance units, and uses the difference in distance between the position at which the printing position is offset frontward by the bi7directional printing correction value and the position at which the specific position pulse is generated, as the distance difference.

4. The printing control system of claim 1, wherein said time estimating means comprises:

base time calculating means for selecting the position pulse generated prior to the first printing position within the distance section, as the selected position pulse, for each distance section determined as the least common multiple of an interval of the printing positions and an interval of the position pulse generation positions, for calculating the distance between the selected position pulse and the first printing position as an offset position, for calculating the required travel time of the offset on the basis of the latest speed information formed by said speed information forming means whenever the selected position pulse is generated, and for calculating the base time as an addition of the required travel time of the offset and the time at which the selected position pulse is received; and said printing time calculating means obtaining the required travel time of the interval at the printing position of the basis of the latest speed information formed by said speed information forming means, whenever the current time matches the estimated arrival time of each printing position within the distance section, and for adding the required travel time to the estimated arrival time to each printing position; and wherein:

said printing timing deciding means uses, as the estimated arrival time, the base time at the first printing position within each distance section, and the value added by said printing time calculating means at the second and after printing positions.

5. The printing control system of claim 1, wherein the system comprises a programmed computer for realizing said timer means, said speed information forming means, said time estimating means, and said printing timing deciding means, and a CPU included in the computer comprises as hardware:

a free-running timer for generating the time information in response to an external clock signal;

a capture register for latching the time information generated by said free-running timer whenever the position pulse is generated;

a first compare register for comparing the estimated arrival time with the time information generated by said free-running timer;

a second compare register for comparing an addition of the estimated arrival time and a predetermined conduction time with the time information generated by said free-running timer; and a flip-flop changed to a set status in response to a match signal form said first compare register and to a reset status in response to a match signal form said second compare register, said flip-flop generating a printing head driving signal when kept set.

6. A printing control method for deciding printing timings at printing positions when a carriage is traveling in accordance with a designated printing density, which comprises the steps of:

generating time information indicative of current time;

generating position pulses at a constant number of pulses per unit travel distance when the carriage is traveling;

forming speed information related to the latest travel speed of the carriage, receiving time information whenever each position pulse is generated, and forming the speed information on the basis of the received time information;

deciding a distance unit so that a common multiple of a preselected printing density and the number of position pulses generated per unit length travel distance to generate distance unit density as a number of distance units per unit length;

estimating time at which the carriage arrives at each printing position on the basis of the speed information, calculating a difference in distance between the selected position pulse and the printing position on the basis of the printing density and the number of position pulses generated per unit travel distance, and estimating the time at which the carriage reaches the printing position on the basis of the calculated distance difference and the speed information, utilizing the distance difference as the number of the distance units, obtaining a required travel time of the distance unit on the basis of the speed information; calculating a required travel time of the distance difference on the basis of the obtained required travel time of the distance unit and the number of the distance units; and estimating the time at which the carriage reaches each printing position, as an addition of the required travel time of the distance difference and the time information at which the specific position pulses are generated; and deciding means for deciding each printing timing at the time when the current time matches the estimated time.

* * * * *